United States Patent [19]

Libby

[11] 4,006,758

[45] Feb. 8, 1977

[54] NARROW WEB LOOM

[76] Inventor: Carl F. Libby, 1212 West St., Stoughton, Mass. 02072

[22] Filed: Aug. 15, 1975

[21] Appl. No.: 604,957

[52] U.S. Cl. ..... 139/116; 139/195; 139/383 R; 139/431; 28/72.16

[51] Int. Cl.[2] ..... D03D 47/04; D03D 47/42; D03D 45/50

[58] Field of Search ..... 139/124 A, 124 R, 116, 139/118, 195, 383 R, 430–432; 28/72.16

[56] References Cited

UNITED STATES PATENTS

| | | | |
|---|---|---|---|
| 2,180,832 | 11/1939 | Libby | 139/124 A |
| 2,537,158 | 1/1951 | Robinson | 139/124 A |
| 3,460,583 | 8/1969 | Musher | 139/195 X |
| 3,536,019 | 10/1970 | Honda et al. | 139/116 UX |

FOREIGN PATENTS OR APPLICATIONS

| | | | |
|---|---|---|---|
| 674,231 | 6/1952 | United Kingdom | 139/195 |

*Primary Examiner*—James Kee Chi
*Attorney, Agent, or Firm*—Barlow & Barlow

[57] ABSTRACT

A Shuttleless Narrow Fabric Loom is provided with a weft inserting means, to insert filling in the warp sheds, there being two weft threads for each insertion. In order to retain the inserted weft threads in the shed and to form a proper selvage, a knitting needle is provided on the opposite side from the inserting means to engage the inserting member to acquire the weft as the inserting member is withdrawn. The needle which has caught the weft retracts in the direction of the warp flow until it casts off the weft previously acquired. During the knitting cycle, the weft is engaged next to the selvage adjacent the knitting needle to draw a measured loop of weft.

3 Claims, 3 Drawing Figures

NARROW WEB LOOM

SUMMARY OF THE INVENTION

This invention relates to a Loom weaving narrow fabrics with low pickage, such as one pick every two inches. Normally Looms have never been designed to operate under these conditions and maintain minimum weft thread tension and as a result are unable to maintain a flat fabric.

Under these conditions, it is essential to produce a knitted loop precisely formed to equal the distance between each inserted weft to reduce strain on the weft and the needle which forms the loop and maintain width of fabric. This invention is applicable to most single weft inserting Shuttleless Looms such as shown in my prior patents U.S. Pat. Nos. 2,696,846; 2,742,932 and 3,237,652.

It is the object of the present invention to provide in a Narrow Fabric Shuttleless Loom a means of holding the fabric together with a minimum of picks so that the weft can be removed after the fabric has been processed in dyeing and finishing.

The mechanism which makes the low pickage possible is a loop-forming arm that engages the weft. This arm is attached to a shaft which is actuated by a crank and linkage so that the loop arm can be adjusted to produce a loop of different lengths corresponding to the distance between each insertion.

The adjustments are made so the arm is in its most forward position as the filling is being cast by the needle. Various lengths of loops are possible by adjusting the loopers forward position. Once the stitch has been cast, the looper moves forward then back into position to repeat the action.

DESCRIPTION OF THE PREFERRED EMBODIMENT

Figure 1:
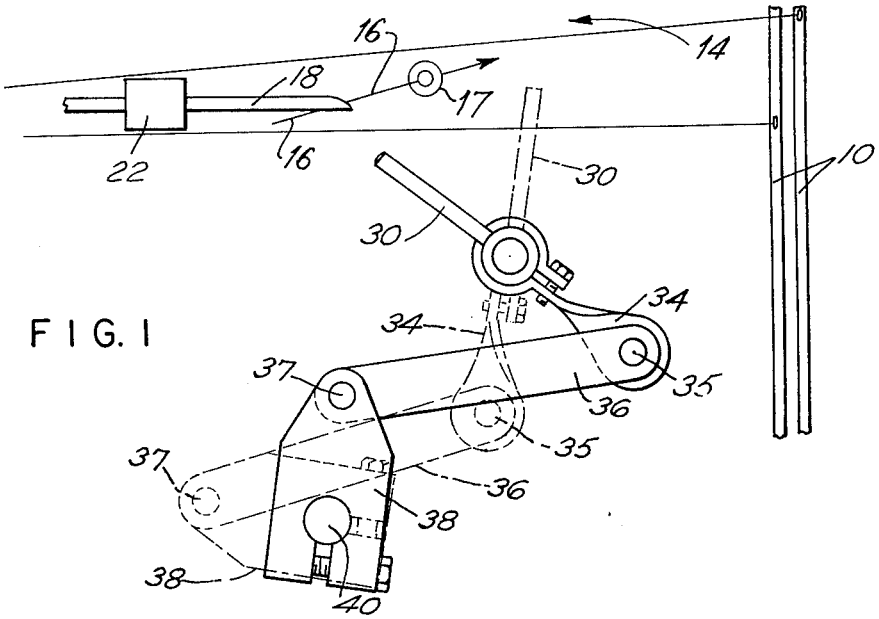
FIG. 1 is a partial diagrammatic side elevational view of a narrow fabric loom embodying the invention.
Figure 2:
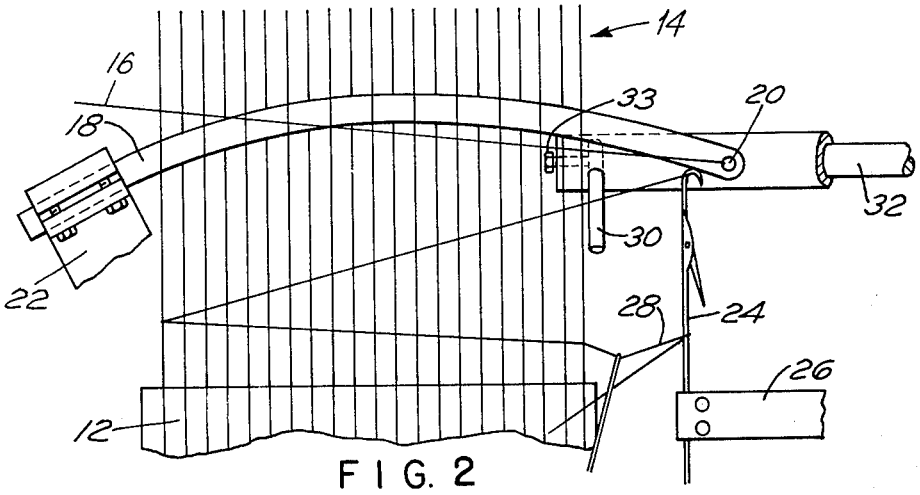
FIG. 2 is a diagrammatic top elevational view illustrating the essential parts of the invention in a first operating position.
Figure 3:
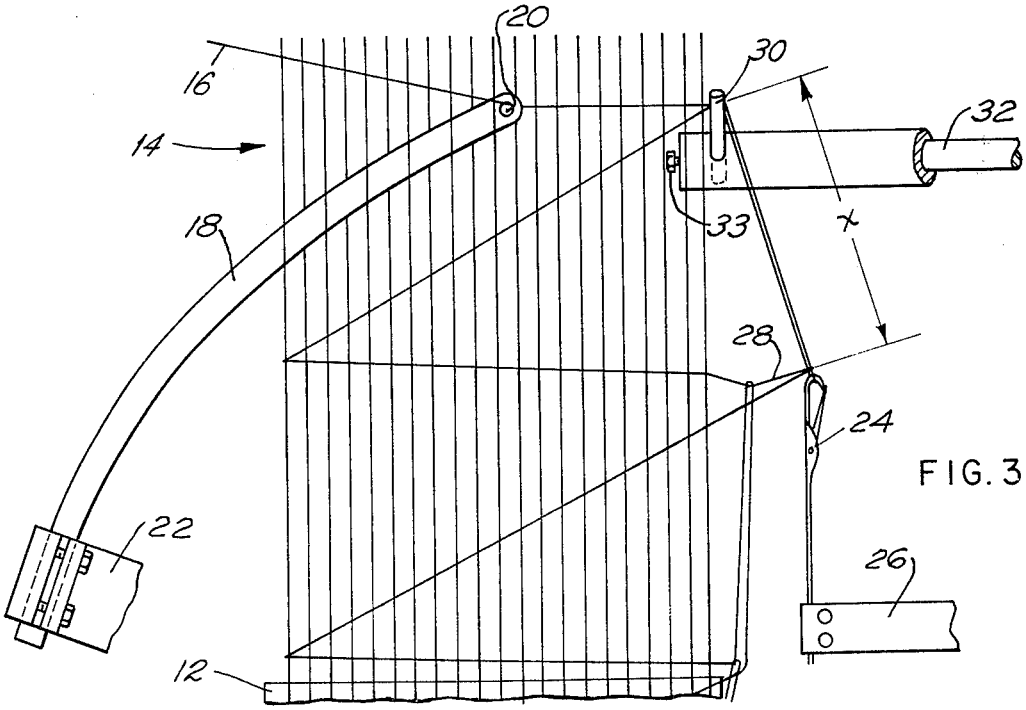
FIG. 3 is a similar view showing the parts in a second operating position.

Referring to FIGS. 1, 2 and 3 there is illustrated diagrammatically the essential parts of a loom for weaving narrow fabrics of webs such as is disclosed in my prior U.S. Pat. Nos. 2,180,831 and 2,180,832 reference to which is incorporated herein for additional parts that need not be completely detailed. The loom is provided with a number of heddles, such as 10, a breast beam 12. As is well known to those skilled in the art a number of warp yarns generally designated 14 are led from a warp beam or suitable supply through the eye of heddles 10 so as to form a shed between the heddles 10 and the breast beam 12 as is well known to those skilled in the weaving art.

A weft thread 16 is supplied from a suitable source (not shown) through one or more guides 17 and is led through a guide eye 20 in an inserting finger 18. The inserting finger 18 is mounted on a rockable arm 22 which is suitably connected to the mechanism of the loom. To insert a weft on each shed cooperating with the weft inserting arm is a knitting needle 24 which is carried in a carriage block 26 disposed in one side of the breast beam 12. The knitting needle 24 is longitudinally slidable by its carriage block 26 which is actuated by a suitable mechanical means such as is shown in prior patents some of which are referred to above. As each loop of weft yarn is projected through the shed by the finger 18, it is caught by the knitting needle 24 such as is shown in FIG. 2. The inserting finger is then withdrawn and simultaneously the knitting needle reciprocates rearward of the breast beam 12 and through the loop of a previous inserted weft, the loop being designated 28. In this fashion the knitted selvage can be provided.

In accordance with the invention, a rockable arm 30 is provided at one side of the warp yarns, and this arm 30 is mounted on a rockable shaft 32, it being appropriate to pass the arm 30 through the shaft 32 and clamp the same therein by an axially directed screw 33. To the shaft 32 there is clamped a link arm 34 which is pivoted as at 35 to an intermediate link 36 which in return is pivoted as at 37 to an arm 38 that is clamped about the rotatable shaft 40. In FIG. 1 the arm 30 is shown in its retracted position, and in dotted lines it is shown in its activated position at which time, as also seen in FIG. 3, the arm 30 will engage the inserted weft and hold the same at a position in the shed. As the insertion needle 18 is withdrawn, the arm 30 moves forward toward the open shed until the needle 24 has cast off the previous weft loop. Effectively, additional weft is inserted into the shed, the additional amount being designated by the distance X as seen in FIG. 3. In this fashion it will be seen that a measured loop is provided for the selvage. The longer loop that is provided is advantageous when the warp yarns that are being utilized are to be treated subsequent to being held together by the weft as, for example, disclosed in the Gibson et al Patent No. 3,605,225 of December 20, 1971.

It will be apparent that a complete cycle of the device consists of opening shed with the heddles 10 inserting the weft with the inserting arm 18, catching the insertion by the needle 24, moving the arm 30 into position and simultaneously withdrawing the insertion arm 18, and also withdrawing the needle 24 and closing the shed and forming a new shed and repeating the process. It should further be noted that the arm 30 should reach its maximum up position as the loop is cast across by the insertion arm 18 so as to obtain positive control of the length of the loop, which length is delineated by the letter X in FIG. 3.

I claim:

1. A method of forming a narrow fabric with low pick count comprising providing a plurality of parallel warp yarns, providing means to insert weft yarns in said warp in alternate sheds, catching each insertion with a needle on the side of the warp opposite from the supply, forming a loop of weft yarn as the insertion means withdraws on the selvage edge adjacent the needle and drawing the weft into a loop previously inserted weft yarn, and providing means on the side of the warp remote from the supply to engage the weft in its withdrawal movement that will determine the amount of inserted weft yarn and establish a measured loop as the weft is drawn into a previously inserted weft yarn loop, the inserted weft yarn in one shed lying at an acute angle to its position in the previous and successive sheds.

2. In a loom for weaving narrow fabrics comprising heddles for producing a shed for warp yarns, a weft insertion finger movable transversely through successive sheds of warp, a latch needle having its shank disposed parallel to the selvage of the warp and spaced therefrom, means reciprocating said needle to cause its shank to engage a weft loop and the hook thereof to engage the next weft insertion wherein the weft is pulled through the previous loop, a weft engaging arm, said arm mounted adjacent the web selvage and needle, means moving said arm into a position after the weft has engaged the needle hook so that as the needle retracts the arm will reach its maximum forward position as the hook of the previous weft is being cast whereby a large weft loop is formed permitting a low pick count.

3. In a loom as in claim 2 wherein said arm is mounted on a shaft for rocking movement, said shaft being coupled through an adjustable linkage to drive means.

* * * * *